United States Patent [19]

Liautaud

[11] 4,363,146

[45] Dec. 14, 1982

[54] EYE WASH FOUNTAIN

[76] Inventor: John R. Liautaud, 180 Stonegate, Cary, Ill. 60013

[21] Appl. No.: 166,986

[22] Filed: Jul. 6, 1980

[51] Int. Cl.[3] ..... A61H 33/00; A61H 33/04

[52] U.S. Cl. ..... 4/620; 4/624; 222/82; 239/590.3

[58] Field of Search ..... 4/617, 619, 620, 623, 4/624, 625; 128/249, 239, 66; 239/543, 590.3, 309; 222/541, 562, 545, 82, 83

[56] References Cited

U.S. PATENT DOCUMENTS

| | | | |
|---|---|---|---|
| 3,413,660 | 12/1968 | Lagarelli et al. | 4/620 |
| 3,602,436 | 8/1971 | Wright | 239/590.3 X |
| 3,629,876 | 12/1971 | Wright | 4/620 |
| 3,809,315 | 5/1974 | Wright | 4/620 X |
| 3,952,918 | 4/1976 | Poitras et al. | 222/82 |
| 4,012,798 | 3/1971 | Liautaud | 4/620 |
| 4,142,651 | 3/1979 | Leopoldi et al. | 222/185 |

FOREIGN PATENT DOCUMENTS

| | | | |
|---|---|---|---|
| 1254961 | 11/1963 | France | 4/620 |

*Primary Examiner*—Houston S. Bell, Jr.
*Attorney, Agent, or Firm*—Hill, Van Santen, Steadman, Chiara & Simpson

[57] ABSTRACT

A portable eye wash fountain assembly generally formed of molded plastic parts includes an L-shaped basin housing, a separate bottle means containing flush liquid, and a tray member. The basin housing is open across the top of its upstanding portion. Recessed within the open top of the basin is the inlet for channel flow means which lead to spaced apart, angularly directed spray nozzle elements located near the leading edge of the horizontal portion of the basin. The tray member, which may be cut from the original basin housing mold, fits within the recess of the basin housing open top. The tray member is formed with a spout opening which extends into the flow inlet. The bottle contains a neck opening and a narrowed upper end formed by an annular ledge. When the bottle is upturned, the neck extends through the tray member spout and the bottle is supported in the open top by virtue of a tight fit with the tray and the bottle ledge resting on the side edges the open top. Elastic cap means joined together by a pull strap seal the spray nozzles until eye-forming is necessary. A liquid seal created by extension of the bottle neck opening into the flow inlet serves to retain liquid in the bottle until the flushing operation is commenced. The bottle opening is preferably sealed to prevent spillage in which case a specifically configured perforation device may be fitted within the flow inlet to break and hold open the seal when the bottle is placed upon the basin housing.

13 Claims, 8 Drawing Figures

EYE WASH FOUNTAIN

BACKGROUND OF THE INVENTION

1. Field of the Invention

The present invention relates to wash fountains and especially to an eye wash fountain for the purpose of flushing irritants and injurious matter from the eyes of workmen.

2. The Prior Art

Government and industry and increasingly aware of the need for protecting the health and safety of workers. For this reason, it is common to find eye wash fountains at industrial work stations, laboratories, and other locations where workers are exposed to gaseous fumes, liquids or solid materials which can irritate or injure eyes upon contact therewith. Recently, the Occupational Safety and Health Administration (O.S.H.A.) has made eye wash fountains mandatory for particular industrial work stations.

Generally, prior art devices have employed eye wash fountains providing sprays of water from regular plant plumbing connections. Since the use of emergency fountains is normally infrequent, a long period of non-use often results in scale and corrosion build-up in unused pipes which can increase injury if sprayed into the eyes. In addition, water in a plumbing system will often be at a different temperature than a room. Unusually cold or warm water can be uncomfortable or even injurious to the user of an eye wash fountain. A distinct disadvantage to these prior art devices is the added expense for installation of the special plumbing connections necessary for the operation of such units. The expense burden these prior art units incur makes compliance with the O.S.H.A. requirement especially troublesome and decreases the availability of eye wash fountains to other workers. Particular examples of eye wash fountains such as these appear in U.S. Pat. No. 3,809,315, which discloses nozzle means for preventing surging of water upon initial opening of a valve, U.S. Pat. No. 3,809,315, which discloses nozzle means for preventing surging of water upon initial opening of a valve, U.S. Pat. No. 3,629,876, which discloses an eye wash fountain having integral nozzles in a basin with valves located on opposite sides of the basin for activation by leaning thereon, and U.S. Pat. No. 3,413,660, which discloses an eye wash fountain having retractable cover members over nozzle outlets for protecting such outlets from air-borne foreign matter.

An improved form of wash fountain is disclosed in U.S. Pat. No. 4,012,798. There is described an eye wash fountain which is independent of any plumbing connections. The fountain has its liquid reservoir within a hollow portable housing and a pair of generally opposed spray nozzles fixed in a lower portion of the housing in communication with the reservoir. The nozzles are blocked while awaiting use, by caps overlying each of the nozzles and joined together by a pull strap. By grabbing the strap and yanking it outwardly, the worker can release the caps from the nozzles and permit a gravity-induced spray of washing liquid. In this manner, an eye wash fountain was presented which was economical and portable and able to deliver a room temperature wash in comparison to uncomfortable cold water washes provided from plumbed wash fountains. However, this form of wash fountain requires the retention of liquid in the fountain after use. A further disadvantage arises in the troublesome form of pour refilling required for this type of wash fountain.

The present invention provides improvements over my fountain system set forth in U.S. Pat. No. 4,012,798, while, at the same time, continuing to offer a room temperature flush from an economical and portable wash fountain system in contrast to other prior art devices.

SUMMARY OF THE INVENTION

In accordance with the present invention, a wash fountain, particularly useful as an emergency eye wash fountain, is made portable and formed of lightweight material, preferably molded plastic. The fountain generally comprises an L-shaped basin housing, a separate bottle or supply means containing a flush liquid such as water, and a tray-like member. The basin housing is cut-away at the upper end of its vertical or upstanding portion forming a open top. The interior of the basin housing is generally hollow, but formed with channel flow means extending from the vertical portion into bifurcated passages, arranged along the horizontal or base portion of the housing and leading to spaced-apart spray nozzles located near the leading edge of the base. The inlet to the channel means is positioned recessed within the open top. The tray member, preferably cut from the original basin housing mold to economize manufacture, is configured to fit within the recess, where cooperating ridge and recess means substantially lock the tray in the basin housing. The tray member is formed with a generally funnel-shaped spout opening along its bottom wall which extends downwardly into the channel means inlet when the tray is fitted in the recess and has an open volume enclosed by sidewalls with which to receive the bottle or supply means. The bottle contains a neck opening and a narrowed upper end formed by an annular ledge. When mounted in the recess, the bottle neck extends through the tray spout opening; and the bottle itself is supported by virtue of a generally tight fit with the tray sidewalls and the bottle ledge resting on the side edges of the open top. A liquid seal created by extension of the bottle neck into the flow channel inlet serves to retain liquid in the bottle means until the flushing operation is commenced.

Elastic caps, which may be joined together by a pull strap, seal the spray nozzles until flushing is necessary, whereupon the user yanks the strap and releases the caps. The nozzles are fitted in raised openings which are angularly directed or canted toward an imaginary apex, beneath which is defined a wash zone overlying the base portion of the housing.

The bottle neck opening is preferably sealed to prevent spillage with such seal means as a cloth, plastic, or paper seal. In these instances, the basin housing is fitted with a perforation element, having a planar surface portion adapted to extend over the channel inlet casing beneath the tray member. A central area of the perforation element directly over the flow inlet is recessed downwardly and carries upwardly standing seal perforation means spaced along the edges of an opening and extending into the spout opening so as to engage the bottle seal. The perforation means may comprise a positioner piece and two identical, substantially semi-circular members, each having a wall surface having a sharp upper edge and gradually ascending to a leading edge. The positioner piece is generally rectangular and extends upwardly at an acute angle over the perforator opening to a height just below the leading edges. The positioner piece may be struck from a continuous wall comprising the semi-circular wall members. In this manner, the wall surface members, beginning with the leading edge, pierce the bottle seal to form a generally semi-circular flap which the positioner piece maintains away from the bottle opening.

DESCRIPTION OF THE PREFERRED EMBODIMENTS

Although the preferred embodiment is directed to an eye wash fountain, those skilled in the art will readily appreciate that the principles of the present invention are applicable to other forms of wash fountains. For example, the instant invention could be utilized to produce a flushing flow of liquid for a user's hand or other body tissues. In the preferred embodiment, almost all of the fountain parts are intended to be made from molded plastic material so as to be lightweight and economical.

Figures 1, 2:
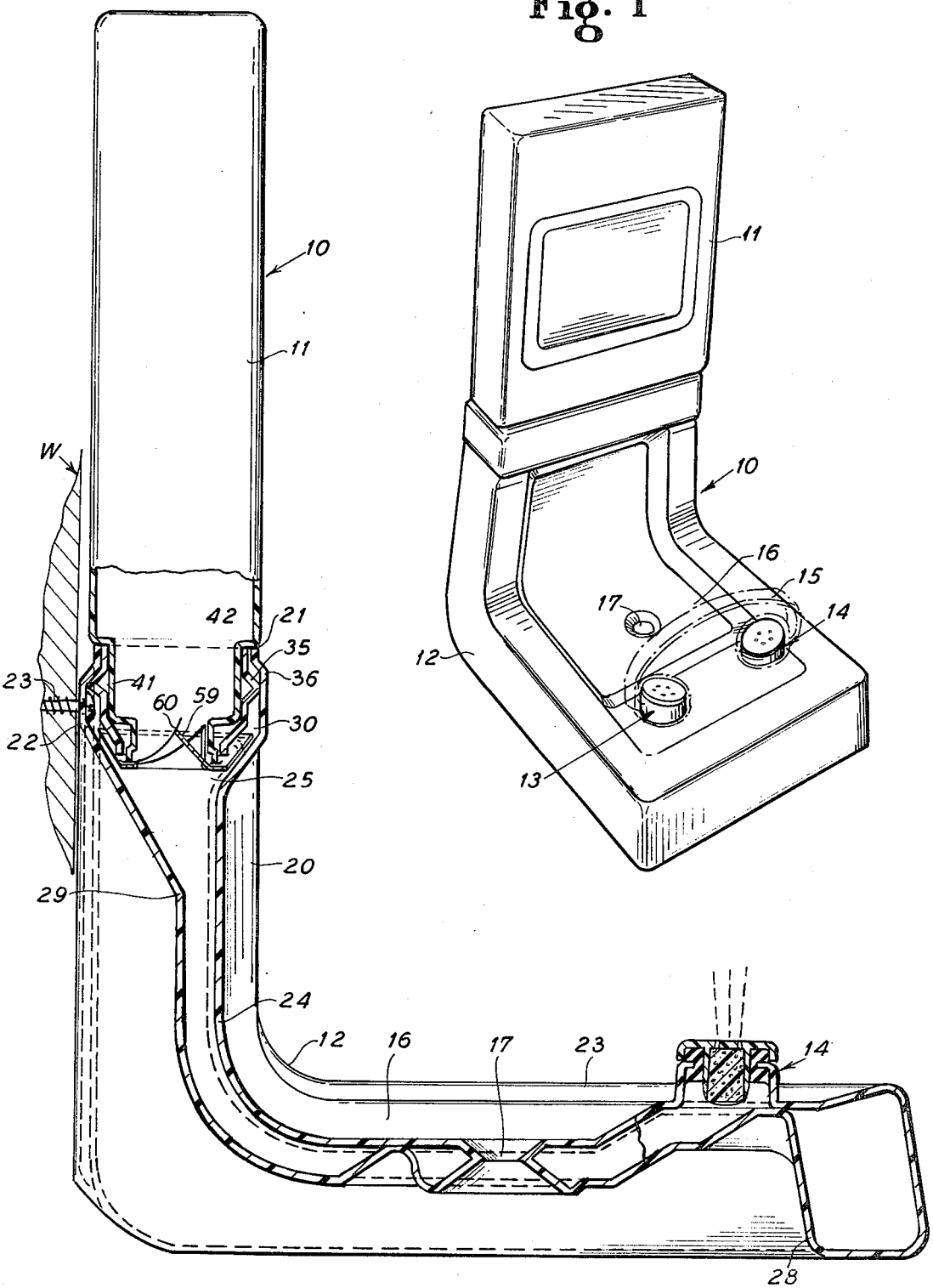
FIG. 1 is a general perspective view of an eye wash fountain of the present invention.
FIG. 2 is a side cross-sectional view of an eye wash fountain of the present invention.

An eye wash fountain embodying the principles of the present invention is shown generally at 10 in FIG. 1. An upturned supply bottle 11 contains wash liquid, such as water, and fits into the open upper end of a generally hollow L-shaped basin housing 12. Flow channel means within the basin housing 12 connect the supply of wash liquid with a pair of spaced-apart spray nozzle means 13 and 14. The spray nozzle means 13 and 14 are sealingly blocked by removable elastic cap means 15, having a pull strap, until flushing is desired. In operation, the eye wash fountain 10 is placed in a position excessible to workers subject to eye contamination. Flushing operation is commenced by grabbing the strap for the cap means 15 to unblock the spray nozzles 13 and 14, whereupon the nozzles direct opposed flows of liquid across a wash zone into which the injured worker places his head. As the injured worker's eyes are washed by the sprays of wash liquid, spent liquid falls into a recessed basin portion 16 beneath the wash zone and is drained away through a drain port 17 formed in the basin 16. The bottle 11 may have a volume and the flow channel means within the basin housing 12 may be sized such that the flow of wash liquid through the fountain 10 can continue for over four minutes. In most instances, a four minute wash period is sufficient for flushing of foreign substances.

Figure 3:
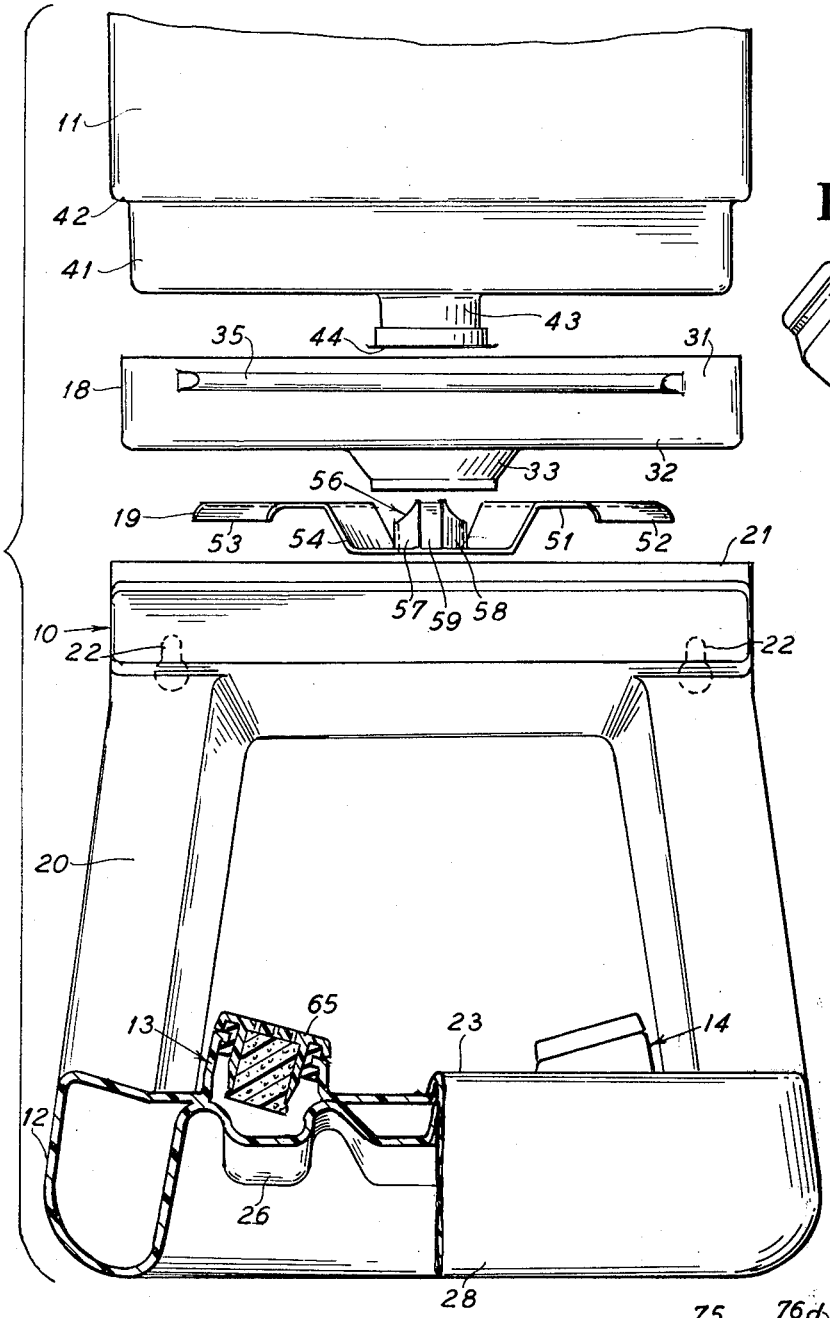
FIG. 3 is a front, part sectional view illustrating assembly of an eye wash fountain of the present invention.

An assembly of separate and independent parts comprising the eye wash fountain 10 of the present invention is illustrated in FIG. 3. The assembly includes the basin housing 12 and nozzle means 13, 14, the bottle 11, a tray member 18, and, preferably, a perforation element 19. Not shown is the elastic cap means 15. The L-shaped basin housing 12 is formed from molded plastic. Its upstanding side portion 20 is cut away at the upper end to form an open top 21. Bracket means 22, such as keyhole slots, are mounted along the back wall of the upstanding portron 20 enabling the fountain 10 to be detachably affixed against a wall W, such as upon bolts 23, as shown in FIG. 2. The bracket means 22 permits the fountain 10 to be mounted at eye level. The horizontal or base portion 22, extends forwardly from the upstanding portion 20 and is connected thereto by means of the generally hollow interiors. The drain port 17 communicates between the basin 16 and the undersurface of the base portion 23. Port 17 may either drain freely or may be fitted with flow conducting means, such as a hose not shown, to carry spent liquid to a remote disposal point. The bottom surface of the horizontal portion 23 is formed on three sides with continuous hollowed-out foot segments 28 so that the fountain 10 may rest stably on a flat surface. Channel flow means 24, illustrated by FIGS. 2 and 5, extend downwardly from a wide mouth inlet opening 25 in the vertical portion 20 along bifurcated passages 26 and 27 formed in the base portion 23 into communication with the nozzle means 13 and 14. From the wide mouth inlet opening 25, cross-sectional area of the channel means 24 narrows to a point 29 after which is a relatively restricted, or small diameter, flow path of constant cross-sectional through to the spray nozzle means 13 and 14. The relatively restricted cross-section of the channel means 24 provides for a substantially steady flow of liquid therethrough regardless of the supply head of liquid in the bottle 11. Hence, it is contemplated by the present invention that the supply of wash liquid be generally outside of the basin housing 12 and channel means 24 extend through the housing 12 to conduct a steady flow of liquid to the spray nozzles 13 and 14. By this arrangement only a small volume of liquid ends up unused in the flushing operation.

Figure 8:
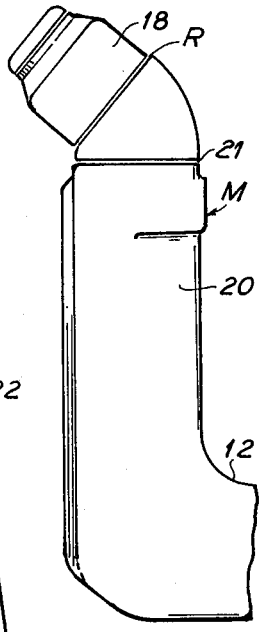
FIG. 8 is a side perspective view of an original mold of the upstanding portion of the basin housing for an eye wash fountain of the present invention.

The flow channel inlet opening 25 begins at a level recessed within the open top 21 of the upstanding portion 20 such that there is a cavity 30 defined beneath the open top 21 and above the inlet 25. Within cavity 30 fits a tray member 18, which is formed from molded plastic and, preferably, cut from the original basin housing mold M in order to economize fountain manufacture. As depicted in FIG. 8, the tray member 18 is preferably cut from the residue part R of the mold M remaining after the upper end of the upstanding portion 20 is sawed away to create the open top 21. The tray member 18 has an open volume enclosed by sidewalls 31 and a planar bottom wall 32. Extending downward from the bottom wall 32 is a generally funnel-shaped spout opening 33. The tray member sidewalls 31 are configured to fit generally snugly in the sidewall confines of cavity 30; however, cooperating ridge and recess means 35, 36 formed on the abutting sidewall surfaces of the tray member 18 and the upper end of the vertical portion 20 and further utilized to substantially lock the tray member in place. Once positioned in the cavity 30, the spout opening 33 extends downwardly into the flow channel means inlet 25.

The open volume of the tray member 18 is to receive and help support the upturned bottle 11. The bottle 11 is preferably made from molded plastic in keeping with the economy of the present invention and translucent such that the liquid level within the bottle may be readily observable. The bottle 11 is formed with a narrowed upper end 41 by means of a ledge 42 extending circumferentially about the bottle side surfaces. The upper end 41 terminates in a neck opening 43 through which wash liquid flows from the bottle 11 when it is upturned. The bottle neck opening 43 is preferably sealed to prevent spillage during assembly of the fountain 10 with the seal means 44, such as cloth plastic, or paper. The bottle 11 is upturned and lowered through the open top 21 to be mounted in the cavity 30. The bottle 11 is supported there by virtue of a generally tight fit with the tray sidewalls 31 which receive the sidewalls of the bottle's narrowed upper end 41 and which are, in turn, snugly supported in the sidewall confines of the housing top cavity 30. The bottle ledge 42 rests on the upper edge surfaces of the open top 21. In this manner, as shown in FIG. 2, the upturned bottle 11 is rigidly supported in the basin housing open top, yet at the same time adapted for ready replacement when the bottle empties. When the bottle 11 is mounted on the upstanding portion 20, the neck opening 43 extends through the tray spout opening 33 and into the channel means inlet 25. Hence, it is contemplated by the present invention that refill of wash liquid to the fountain 10 can be accomplished quickly and easily be removing an empty bottle from the open top 21 and replacing it with a filled bottle.

Figure 4:
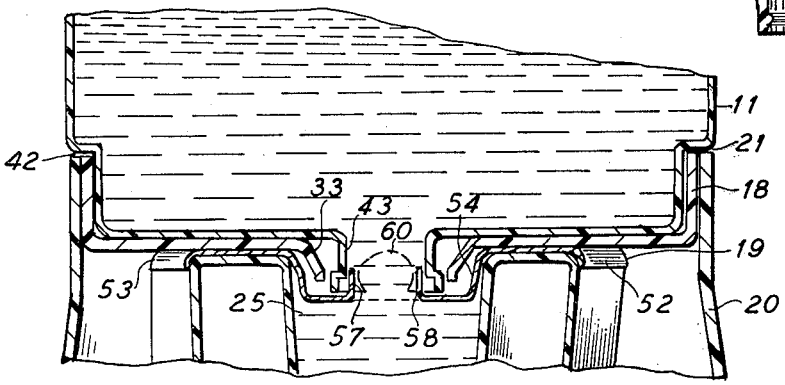
FIG. 4 is a detailed front cross-sectional view of the bottle means mounted in the basin housing of an eye wash fountain of the present invention.
Figure 5:
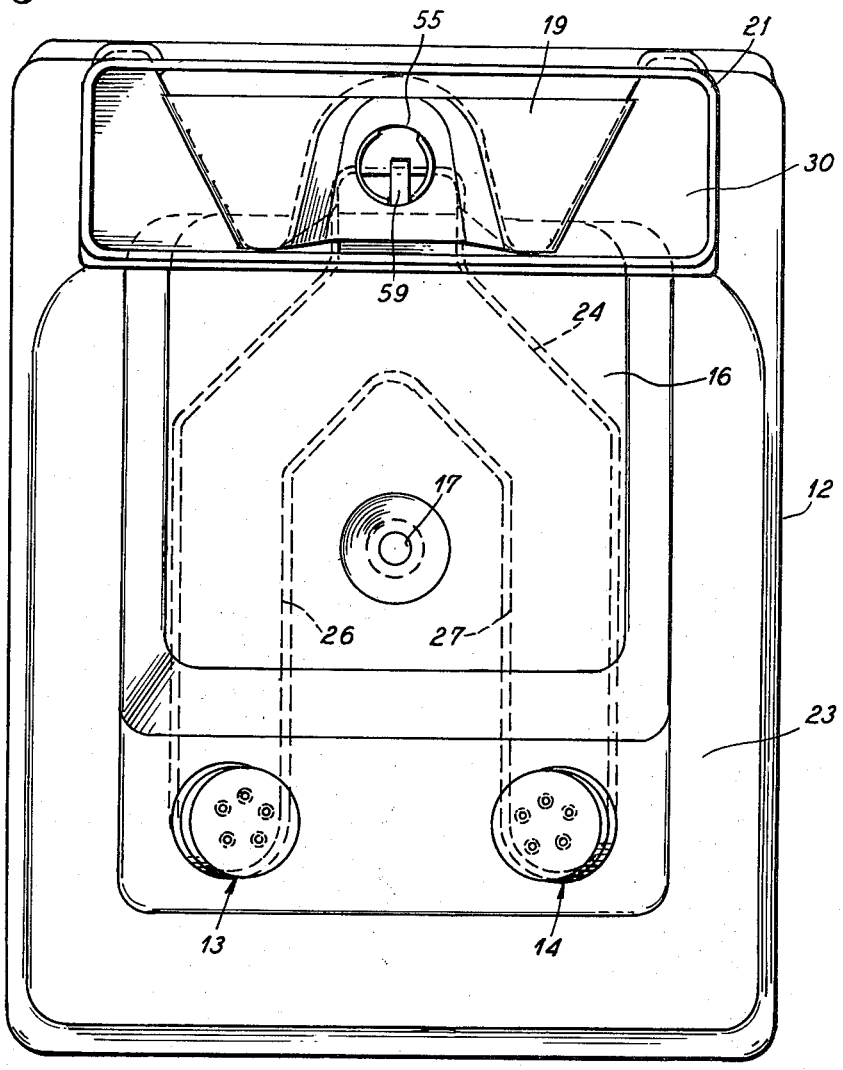
FIG. 5 is a top plan view of the basin housing for an eye wash fountain of the present invention.

When the bottle opening 43 is blocked with seal means 44, the wash fountain 10 is fitted with the perforation element 19, which may be formed from metal between the upper edge surfaces of the channel inlet 25 and the bottom wall surface of the tray 18. The perforation piece 19 generally takes the form of a planar surface 51 of a width able to fit within the cavity 30. Opposed ends 52 and 53 of the surface 51 may be curved inwardly downward so that the perforation element 19 can be stably mounted directly over the flow channel inlet 25 by virtue of frictional engagement with outer casing walls defining inlet 25 as shown in FIGS. 4 and 5. Centrally located on the perforation element 19 in an area directly over the flow channel inlet 25, there is a downwardly recessed middle portion 54, having formed on the bottom surface thereof an aperture 55. Seal perforation means 56 comprises seal-engaging wall surfaces 57–59 extending upwardly about the aperture 55. To initially pierce the seal 44, there are two substantially semi-circular member walls 57 and 58 which are oppositely facing about the opening 55, each having sharp upper edges gradually ascending towards a leading edge facing the opposed wall surface. Tab 59 in the form of a generally rectangular metal piece extending upwardly at an acute angle over the aperture 55 from between the walls 57 and 58 to a height just below the leading edges of the wall surfaces 57 and 58 serves a seal positioner means. The positioner piece 59 may be struck from the wall surfaces 57 and 58 which may be formed by punching out opening 55 from the middle portion 54 of the perforation element 19. Referring to FIGS. 2 and 4, the perforation means 56 engage seal 44 when the bottle 11 is fit into the open top 21 of the fountain 10. Surfaces 57 and 58 serve to pierce the seal 44 to form a generally semi-circular opening in the surface of the seal 44, which continues to tear until a flap pierce 60 is created in the seal material. The positioner piece 59 maintains unobstructed fluid flow through the bottle neck 33 by raising flap 60 away from the opening formed in the seal face 44.

As will be described further below, nozzle means 13 and 14 remain blocked until cap means 15 is removed by the user. A liquid seal, illustrated in FIG. 4, is formed by positioning of the bottle opening 43 beneath the upper edges of the flow inlet 25 to retain liquid statis in the bottle 11 until the flushing operation is commenced. When liquid is permitted to flow out through the nozzle means 13 and 14, the liquid level in the flow inlet 25 drops to where the opening in the surface of the bottle seal 44 is exposed to ambient air. Air then passes into the bottle 11, enabling liquid to flow out. Accordingly, liquid percolates from the bottle 11 into the flow channel inlet 25; however, due to the relatively restricted cross-section of the lower flow channel passages flow from the nozzle means 13 and 14 is smooth and constant. Hence, an easily assembled and inexpensive eye wash fountain containing a separate supply bottle attached thereto is contemplated by the present invention.

Figure 7:
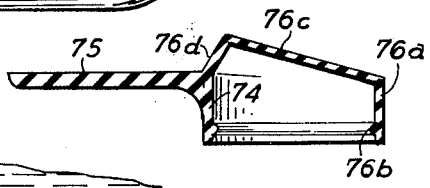
FIG. 7 is a side cross-sectional view of a nozzle cap for an eye wash fountain of the present invention.
Figure 6:
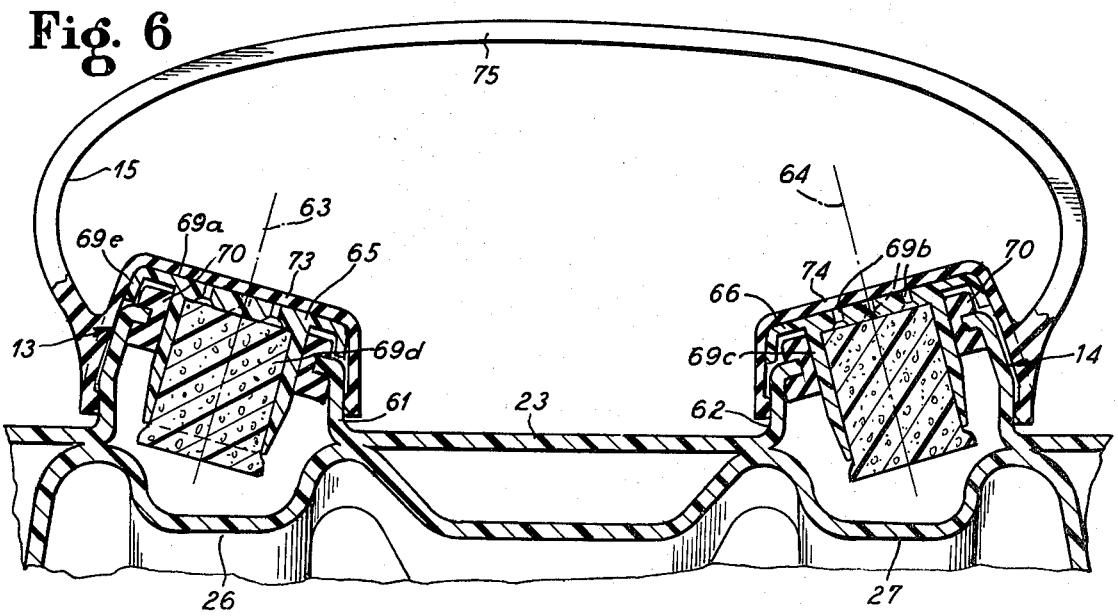
FIG. 6 is a detailed side cross-sectional view of the nozzle portions and caps for an eye wash fountain of the present invention.

Detail of the nozzle means 13 and 14 and removable cap means 15 is shown in FIGS. 6 and 7. The bifurcated flow passages 26 and 27 extend near the leading edge of the base portion 23 into respective open-ended, cylindrical confines 61 and 62 appearing as raised surfaces on the base 23. The upper ends of the confines 61 and 62 contain central circular openings having axes 63 and 64 angularly directed toward an imaginary apex. A wash zone for eye flushing is thereby defined beneath this apex overlying the base 23 and basin 16.

Positioned coaxially within each respective confine opening are spray nozzles 65 and 66, preferably made of plastic and which are identical such that only one description is necessary. Each nozzle comprises a generally planar upper surface **69*a* through which extend a plurality of jet nozzles 69*b*. A cylindrical wall means 69*c* extends integrally downward from the planar surface 69*a* such that the wall 69*c* encloses a flow path space communicating with the jet nozzles 69*b*. A removable porous filter element 69*d* may be frictionally secured with the cylindrical flow space to prevent solid impurities in the wash liquid from being expelled into the user's eyes. The nozzles 65 and 66 are respectively each sealably supported with the confine openings by removable seal means, such as rubber grommet means 70, circumferentially interposed between the exterior of the cylindrical wall means 69*c* and the confine opening edges. Preferably, each grommet 70 is formed with a circumferential groove 71 sealably receiving confine opening edge surfaces and curved end surfaces 69*e* extend downward from the planar surface 69*a* of each nozzle to fit the nozzle snugly over the outer edges of the grommet 70**.

Cap means 15 is preferably plastic and includes two nozzle caps 73 and 74 joined together at their outermost edges by a pull strap 75. The caps 73 and 74 are identical such that only one description is necessary. Referring particularly to FIG. 7, each cap is comprised of a generally cylindrical wall portion **76*a* able to fit concentrically over exterior wall surfaces of a respective confine 61 and 62. A radially inward extending ring 76*b* is formed integrally along the lower interiorly facing surface of the wall member 76*a* to frictionally and sealingly engage the confine's exterior wall surfaces. The upper end of each cap is closed by a generally planar surface 76*c* angularly directed from the upper edges of the cylindrical wall 76*a* so as to be generally parallel to the angularly directed nozzle surface 69*a*. A further wall portion 76*d* closingly connects upper edges of the cylinder wall 76*a* to the raised edges of the planar surface 76c. Hence, it is contemplated by the present invention that an immediate and substantially constant flow of wash liquid issue from spray nozzle means 13 and 14 when a user yanks pull strap 75 and removes the caps 73 and 74** sealing the nozzles.

By placing the connection of the pull strap 75 on the outside portion of the caps 73,74 it has been found a more instantaneous removal of the caps occurs when the strap 75 is yanked and there is no tendency for the caps to hang-up on the outer surfaces of the nozzles 13,14.

It will thus be seen that an eye wash fountain has been provided in which the liquid supply is above the fountain and is substantially entirely expelled from the nozzles. A plurality of standard bottles 11 may be stored adjacent the fountain in a sealed condition to insure a long flush where needed. The bottle 11 may be constructed in any vertical height dimension.

Although various other minor modifications may be apparent by those versed in the art, it should be understood that I wish to embody within the scope of the patent warranted hereon all such modifications as reasonably and properly come within the scope of my contribution to the art.

I claim as my invention:

1. A portable wash fountain adapted for quick refill comprising:

a basin housing having spray nozzle means positioned thereon, an open top defined by upstanding sidewalls of said housing, and flow channel means extending from an inlet end recessed in said upstanding sidewalls adjacent said open top to said spray nozzle means, a separate tray member defining an open volume and having a bottom wall formed with an orifice for facing said inlet end of said flow channel means and sidewalls adapted to be fitted against said open top sidewalls, a separately removable bottle means for containing a wash liquid having a neck opening at an upper end, said bottle means for being mounted through said open top and said upper end adapted to be received in said tray member for firm support thereof by said tray member and open top sidewalls such that said neck opening extends into said tray member orifice, and cap means sealably fitting over said spray nozzle means to block flow therefrom and readily removable from said spray nozzle means when flushing with wash liquid is desired.

2. The portable wash fountain according to claim 1, wherein said basin housing and tray member are formed from molded plastic, said tray member being cut from the same mold for said basin housing.

3. The portable wash fountain according to claim 1, wherein said bottle neck opening is blocked by a seal and further comprising a perforation element lying across said flow channel inlet end, said perforation element having perforation means to break said seal when said bottle means is mounted through said open top.

4. The portable wash fountain according to claim 3, wherein said perforation element comprises an aperture enclosed by seal-breaking surfaces, said surfaces comprising members to pierce the surface of said seal, form a flap portion in the seal surface, and raise said flap portion away from said bottle opening.

5. The portable wash fountain according to claim 1, wherein the upper end of said bottle is relatively narrowed by means of a ledge, said ledge resting on the upper edge surfaces of said open top when said bottle is mounted through said open top.

6. The portable wash fountain according to claim 1, wherein said flow channel inlet end has relatively wide mouth which tapers to a point in said flow channel means whereafter the flow path cross-sectional area is generally constant and relatively restricted.

7. The portable wash fountain according to claim 1, wherein said spray nozzle means each comprises a removable nozzle member fitted coaxially in an opening at the top of a raised confine.

8. The portable wash fountain according to claim 7, wherein each said spray nozzle means includes a removable porous filter means carried by each said nozzle member.

9. The portable wash fountain according to claim 7, wherein there are two spaced-apart spray nozzle means, the raised openings containing the nozzle members being angularly directed toward an imaginary apex overlying said basin housing and defining thereby a wash zone in which wash flow from the spray nozzle means flushes eyes.

10. The portable wash fountain according to claim 1, wherein said cap means comprises caps joined together by a strap.

11. The portable wash fountain according to claim 1, wherein said basin housing is generally L-shaped, the horizontal portion of said housing containing said spray nozzle means.

12. An inexpensive and lightweight portable wash fountain made of molded plastic comprising:

a housing having a basin portion with at least one spray nozzle means positioned thereon and a side portion upstanding from said basin portion and formed with sidewall confines defining an open top, a free flow channel means extending from an inlet end recessed in said side portion adjacent said open top to said spray nozzle means, a tray member having sidewalls defining an open upper end and a bottom wall formed with an orifice, said tray member sidewalls fitting within the sidewall confines of said side portion open top with said orifice facing said inlet end, and a separate bottle means for containing a wash liquid having a neck opening at one end, which is mounted against said tray member sidewalls with said neck opening facing into said tray bottom wall orifice.

13. The portable wash fountain of claim 12, wherein said neck opening is blocked by a seal and further comprising a perforation element, positioned between said inlet end and said tray member, having means to break said seal when said bottle is mounted in said tray member.

* * * * *